US009412239B2

(12) United States Patent
Gugler

(10) Patent No.: US 9,412,239 B2
(45) Date of Patent: Aug. 9, 2016

(54) GAMING MACHINE INCLUDING WIN CHAINS

(71) Applicant: NOVOMATIC AG, Gumpoldskirchen (AT)

(72) Inventor: Martin Gugler, Baden (AT)

(73) Assignee: Novomatic AG, Gumpoldskirchen (AT)

( * ) Notice: Subject to any disclaimer, the term of this patent is extended or adjusted under 35 U.S.C. 154(b) by 35 days.

(21) Appl. No.: 13/757,552

(22) Filed: Feb. 1, 2013

(65) Prior Publication Data

US 2014/0221074 A1 Aug. 7, 2014

(51) Int. Cl.

| | |
|---|---|
| ***A63F 9/24*** | (2006.01) |
| ***G07F 17/34*** | (2006.01) |
| ***G07F 17/32*** | (2006.01) |

(52) U.S. Cl.

CPC ..... *G07F 17/34* (2013.01); *G07F 17/3267* (2013.01)

(58) Field of Classification Search

CPC . G07F 17/32; G07F 17/3267; G07F 17/3258; G07F 17/3244

See application file for complete search history.

(56) References Cited

U.S. PATENT DOCUMENTS

| | | | | |
|---|---|---|---|---|
| 7,258,611 | B2 | 8/2007 | Bigelow, Jr. et al. | |
| 8,272,939 | B2 | 9/2012 | Leger | |
| 8,574,053 | B1 * | 11/2013 | Nelson et al. | 463/16 |
| 2009/0124330 | A1 * | 5/2009 | Leger | 463/20 |
| 2010/0210336 | A1 * | 8/2010 | Berman et al. | 463/16 |
| 2010/0210346 | A1 * | 8/2010 | Berman et al. | 463/20 |
| 2012/0052935 | A1 * | 3/2012 | Vancura et al. | 463/20 |
| 2012/0295689 | A1 * | 11/2012 | Owen et al. | 463/20 |
| 2013/0005430 | A1 * | 1/2013 | Cuddy et al. | 463/20 |
| 2013/0065663 | A1 * | 3/2013 | Johnson et al. | 463/20 |
| 2014/0087829 | A1 * | 3/2014 | Watkins et al. | 463/20 |

FOREIGN PATENT DOCUMENTS

| | | | |
|---|---|---|---|
| EP | 0874337 | A1 | 10/2008 |

* cited by examiner

*Primary Examiner* — James S McClellan
*Assistant Examiner* — Kevin Carter
(74) *Attorney, Agent, or Firm* — Kevin H. Fortin

(57) ABSTRACT

A gaming machine has a standard game play mode, and a bonus feature game play mode. The bonus feature mode includes a win chain counter having an integer value. During standard game play mode, the user interface randomly displays a matrix of symbols and the computer calculates the wins based on the matrix of symbols. On appearance of a predetermined number of scatter symbols, bonus feature play commences and a the win chain counter is initialized. During bonus feature play, a winning spin initializes a first win chain, and a first non-winning spin decrements the win chain counter value, after a first win chain is initialized, and prior to a non-winning spin, winning spins are added to the first win chain. Subsequent win chains are generated and terminated by a non-winning spin until the win chain counter is decremented to zero. Then bonus feature game play terminates.

18 Claims, 6 Drawing Sheets

GAMING MACHINE INCLUDING WIN CHAINS

FIELD OF THE INVENTION

The invention pertains to gaming machines including slot machines, and particularly to slot machines having bonus feature game play.

BACKGROUND OF THE INVENTION

In the gaming machine industry, there is a continuing need for gaming machine manufacturers to produce new types of games, or enhancements to existing games, which will attract frequent play by enhancing the entertainment value and excitement associated with the game. Presently, there is a trend with slot machines to offer additional games that can be played in addition to the standard game play involving spinning reels. These additional games are often referred to as a "feature game", or "bonus game". A slot machine is a game of chance involving the spinning of a set of mechanical reels, or the random changing of a matrix of symbols.

A matrix of symbols can be adapted in size, shape and orientation to represent a set of mechanical reels. Symbols can be digitally represented, or physically represented, and may be augmented by video, and highlighted by supplemental lighting. Digital and physical representations of symbols, can be combined for improved effect.

EP0874337A1 of Demar et al. discloses a gaming machine is operated by a programmed micro-processor in which the first mode of operation, a basic game, is implemented such as video poker or reel-type slot machine play. If bonus symbols are selected in the basic mode, a bonus mode is triggered. In the bonus mode the same or a different game is implemented by the micro-processor system employing a Bernoulli trial procedure in which the player continues to play and receive awards until a losing combination occurs. The hit rate for the bonus mode is greater than 50% although the overall pay out percentage of the game remains below 100.

U.S. Pat. No. 7,258,611B2 to Bigelow, Jr. et al. discloses an apparatus and method for a bonus game, and particularly a free spin bonus with an incrementing multiplier. The bonus game includes a plurality of reels having a plurality of symbols and multipliers. The gaming device provides a number of free spins to the player at the beginning of the bonus game. The multiplier preferably starts at "1.times." and increases by one after each free spin. Initially, the player spins the reels attempting to obtain a winning symbol combination on the reels. If the player obtains a winning combination, the gaming device provides an award. The award is multiplied by the multiplier and the player receives the multiplied award for that free spin. The player continues to spin the reels until there are no free spins remaining in the bonus play.

However, in both of these cited documents, the game does not continue once the players lose. Moreover, it is not shown how cumulative credits are awarded upon termination of the bonus game play.

The gaming industry is very competitive and evolving continuously. Although, many games continue to entertain gaming enthusiasts, there is still an unmet need for better and more interesting games and features. There is also an unmet need for making gaming experience user-friendly to enable a player to readily understand the various gaming features and available variations thereof, particularly with respect to the feature games that follow different steps than the standard slot machine reel play.

SUMMARY OF THE INVENTION

A gaming machine can be a personal computer, or a standalone kiosk. In either case, the gaming machine has at least one standard game play mode, and at least one bonus feature play mode. The bonus feature play mode includes game play counters. A win-chain feature is also enabled and is used in bonus feature game play mode. The win-chain feature can be adapted for use with standard game play mode.

During both standard and bonus feature game play mode, the user interface randomly displays a matrix of symbols and the computer calculates the wins based on the matrix of symbols. The matrix of symbols represents a reel set spin of a slot machine in one embodiment of the invention.

On appearance of a predetermined number of scatter symbols in the matrix, bonus feature play commences and a predetermined number of win chain counters are awarded. During bonus feature play, a winning spin initializes a first win chain, and a first non-winning spin changes, i.e. decrements the at least one win chain counter. After a first win chain is initialized, and prior to a non-winning spin, winning spins are added to the first win chain.

Numerous win chains can be generated, all win chains are terminated by a non-winning spin until all of the win chain counters are consumed then bonus game play terminates. Bonuses can be derived from bonus feature play mode, including additional game play credits that yield free reel spins, and improved multipliers for payouts.

In one example, upon termination of bonus feature play, the sum of winning spins in the win chain yields bonus credits to a player. In an alternate embodiment, upon termination of bonus feature play, the sum of the win chains is used to calculate a payout. Preferably, the payout is multiplied by the number of win chains. In this embodiment, payouts resulting from game play including two or three win chains, are doubled or tripled.

After a non-winning spin consumes the at least one win chain counter, a winning spin initializes a second win chain. After the second win chain is initialized, and prior to a second non-winning spin, winning spins are added to the second win chain.

In one embodiment, upon termination of bonus feature play, the sum of winning spins in the first and second win chain yields bonus credits to a player. Payout calculations, according to an alternate feature of the invention, are based on a threshold number of win chains and the payout is at least doubled, and may be tripled, when the threshold number of win chains is met.

Preferably bonus feature play commences when at least three scatter symbols appear, and the bonus feature play yields four win chain counters.

DETAILED DESCRIPTION

Figure 1:
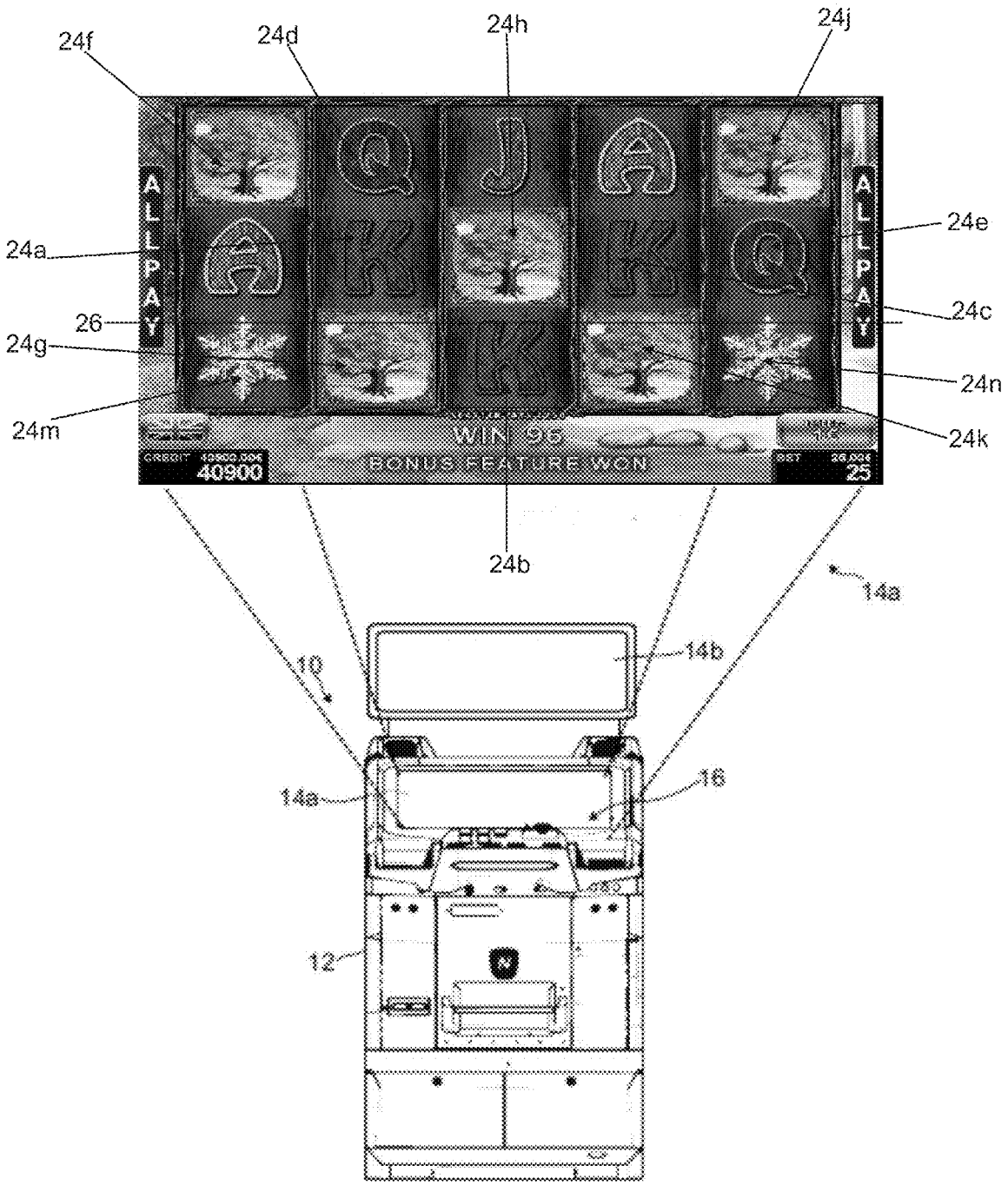
FIG. 1 is a front view of a housing displaying a slot machine reel.

FIG. 1 shows a gaming machine 10. The gaming machine 10 is a slot-machine capable of various game play modes. Initially the gaming machine 10 operates in a standard game play mode until the occurrence of a random event, and then the gaming machine 10 operates in a bonus feature play mode. In standard game play mode, a matrix of symbols are displayed in a format which includes an imitation of a mechanical reel set with a matrix of five reels in columns and each reel having three symbols running vertically. The term "matrix of symbols" and the term "reel set" are used interchangeably herein.

The gaming machine 10 is preferably a slot machine which includes a housing 12 with a lower display 14*a*, an upper display 14*b* and a user interface 16. The slot machine is broadly construed as any gaming machine that is capable of enabling a player to play for entertainment with a probability of a payout or other winnings.

The interface 16 is supported by the housing 12. The interface 16 optimally faces a user, who may be standing or sitting in proximity to the machine 10. The interface 16 enables user to input his choice to initiate and/or continue the game play. In particular, a number of buttons can be presented on the interface to enable a user either to commence the standard game play mode, or continue further the bonus feature play mode by selecting bets for playing a plurality of win seasons each having a possibility of at least one chain. The maximum length of any win chains is potentially infinite.

According to one aspect of the invention, the display 14*a* is configured to display a matrix of symbols 24 that imitate the mechanical slot machine reel set in the standard game play mode to one aspect of the invention. Accordingly, each column of the matrix imitates a single mechanical slot machine reel set. The display 14*a* is disposed angled with respect to the floor to optimally face a user.

In another embodiment of the invention, it is contemplated that the display 14*a* may include a hybrid arrangement having both digital and mechanical components. The display 14*b* is transmissive to facilitate highlighting of any of the various symbols, and paylines to facilitate the game play. Here, the interface also provides images that overlay the mechanical reels.

The matrix of symbols 24 has three rows and five columns. The matrix of symbols 24, however, may include any number of rows and columns in accordance with various game formats. As shown, the matrix of symbols 24 includes a plurality of symbols 24*a*, 24*b*, 24*c*, 24*d* and 24*e*, and scatter symbols 24*f*, 24*g*, 24*h*, 24*j*, 24*k*, 24*m* and 24*n* etc.

Scatter symbols 24*f*, 24*g*, 24*h*, 24*j* 24*k*, 24*m* and 24*n* are special symbols because they have the potential to directly or indirectly lead to larger payouts. The icon on the scatter symbol 24*f*, 24*g*, 24*h*, 24*j*, 24*k*, 24*m* and 24*n* is usually closely associated to an important aspect of the theme of the online slot because of its importance. Scatter symbols 24*e*, 24*f*, 24*g*, 24*h*, 24*j*, 24*k*, 24*m* and 24*n* can contrast with other symbols 24*a*, 24*b*, 24*c*, 24*d* and 24*e*, so that they can be easily seen among a matrix of symbols. The scatter symbols 24*e*, 24*f*, 24*g*, 24*h*, 24*j*, 24*k*, 24*m* and 24*n* can also be made brighter or more animated than other symbols, for example. Scatter symbols 24*f*, 24*g* 24*h*, 24*j*, 24*k*, 24*m* and 24*n* differ from other symbols in that they simply lead to improved payouts and additional credits, rather than replace other symbols as a wild card functions in a card game play, for example.

In another aspect of the invention, the gaming machine 10 presents a poker-style game. The matrix of symbols 24 includes the playing card values, such as King, Jack, Queen, and various numerical card values. The matrix of symbols 24 may also include any other symbols that create interest to a player including the scatter symbols 24*f*, 24*g*, 24*h*, 24*j* and 24*k*. Although, a poker-based theme is described herein, it can be appreciated that the present invention may also encompasses non-poker based themes without departing from the scope of the present invention.

The symbols 24 can also include still images, or video-streamed images, or a combination thereof. Such still images or video streamed images or any combination thereof, may be displayed using a combination of physical reels and virtual reels. Video streamed images enable the symbols 24 to yield an evolving appearance. In particular, the size, character and the transparency of the symbols may change during the game play, particularly upon the appearance of a scatter symbol. When physical reels are also used, the images may be highlighted or changed, for example, by using a projection using transmissive technology on the display 14*a*.

The display 14*a* shows any number of paylines crossing horizontal and vertical rows and columns, respectively. In particular, a payline 26 is shown extending horizontally across the third row of the matrix of symbols 24. Any of a variety of paylines can be defined on the display 14*a*, including the vertical, diagonal and irregular pay lines. All prizes are for the combinations of a kind. However, the prizes are for the combinations in the matrix running from left to right only. Moreover, the scatter symbols pay at any position on the screen. The highest win is only paid per combination on the screen. All prizes are shown in credits. It is to be noted that any malfunction of the game voids all pays and plays.

The payline 26 crosses through the top row of the matrix of symbols and is projected on the display 14*a* and thereby indicates a payout. Evaluation means are provided for evaluating scatter symbols in the matrix and triggering on the bonus feature play mode upon appearance of a predetermined number of the scatter symbols in the matrix. The evaluation means in an exemplary embodiment may be a software and/or hardware routine to check a memory area of the computer, which memory area represents and keeps information stored of the matrix of symbols.

Bonus feature game play mode is effectuated upon the appearance of a threshold number of scatter symbols. In this example, when least three scatter symbols in the standard game play mode, bonus feature play mode is initiated. In other embodiments of the invention, the bonus feature play mode may be initiated when four or five scatter symbols appear, respectively.

Here, five scatter symbols 24*f*, 24*g*, 24*h*, 24*j* and 24*k* appear and enable the bonus feature play, so that the payout is according to the payline 26. Preferably, the bonus feature play mode is automatically initiated and accepted by enabling a user to activate a button or lever on the interface 16. The matrix of symbols disappears and it is completely replaced by the bonus feature play images when the gaming machine 10 enters in the bonus feature play mode. In an alternate embodiment, the bonus feature play mode is displayed on the upper display 14*b*. However, it may be appreciated that the variants of the invention can retain a portion of the information and symbolism presented from standard game play mode in the bonus feature play mode, such as a bet amount.

Figure 2:
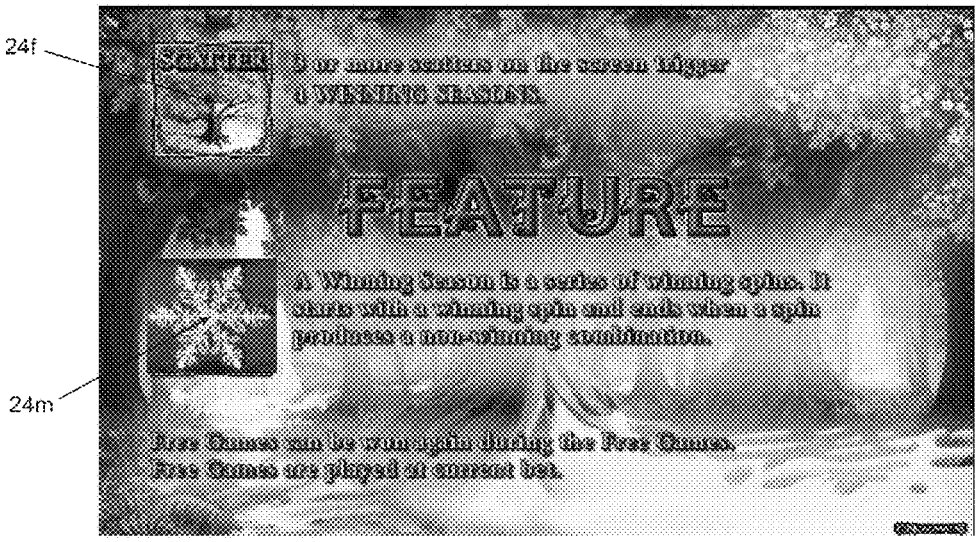
FIG. 2 is a screenshot of the bonus feature play in accordance with the present invention depicted on the display.

FIG. 2 shows the display 14*a* presenting an initial screen shot of bonus feature play mode, this screen shot details the basic steps of bonus feature play mode.

Winnings can be achieved by the appearance of a scatter symbol, or by a pay line otherwise yielding a win. A payline can be defined in any of a variety of ways, which are well known in the art.

The appearance of a threshold number of scatter symbols also yields bonus feature play having a win chain counter. The win chain counter, in this example, is represented as a "Winning Season" having an associated symbol 24*m* which enables free spins and more wining opportunities when a threshold of three scatter symbols appear. According to game play steps, a win chain counter having an integer value of four is initiated in bonus feature play mode.

Although the win chain counter is represented as four "Winning Seasons" according to this embodiment of the invention. It can be appreciated that any other representation may be used according to game varied game themes and varied game play steps, and any other threshold number of scatter symbols can be used to initiate the win chain counter.

The bonus feature play starts with a reel set spin and terminates after a non-winning combination appears four times, thus decrementing the integer value of the win chain counter, which is represented by the four "Winning Seasons". One of the scatter symbols 24*f* is shown and it is illustrated that on appearance of three or more such scatter symbols, an integer value of four is initially set for the win chain counter.

A "Winning Season" yields a number of non-winning combinations that will terminate bonus feature play mode. While four win chain counters, i.e. "Winning Seasons" are awarded, it can be appreciated that the game can be adapted to have any of a variety of game themes, other than "Winning Seasons".

In this case, for example, four game play counters are represented by the four seasons of the "Winning Season" bonus feature play. Each non-winning reel set spin exhausts one of the "Winning Season" bonus feature play spins. A winning reel set spin enables continued game play in bonus feature play mode. After a total of four non-winning reel set spins, bonus feature play mode terminates.

An advantage of this bonus feature play is that free games can be won again during the bonus feature play mode as well as the standard game play mode. The bonus feature play mode reel set spins are played at the current bet utilized when bonus feature play mode is awarded.

Bonus feature play can be extended when three or more scatter symbols appear. In accordance with the present invention, the cumulated games won during bonus game play mode games can be won as "Win Chains" and the players can win a certain number of "Win Chains". Here, a "Win Chain" is meant by an uninterrupted series of winning spins. The minimum number of a win chains is zero and the maximum possible length of a win chain is potentially infinite. A win chain is electronically recorded by the computer for each win (yielding a series of wins), whether from a scatter symbol or a payline, and from a bonus feature play having these results.

An important advantage of the present invention is to award a series of wins in order to allow the player to continue playing free games until a non-winning spin occurs, so the bonus feature play is possible as long as winning spins continue.

Yet another important advantage of the present invention is that if at least three win chains are achieved during the game play, whether via a normal game play or via a bonus feature play, the cumulative credits may be awarded, which can be added to the total credits.

A still further advantage of this invention is that "Win Chains" enable the bonus feature play to continue infinitely, i.e. it may go on so long as winning reel set spins continue.

The payout calculations in the bonus feature play may be similar to the normal game play by evaluating symbol values on the pay line, i.e. a winning combination may be three of a kind, four of a kind, or five of a kind etc. on the respective pay line.

Benefit of the present invention with the concept of "Win Chains" is to enable a player to maximize game play enjoyment, and engage in game play for a longer period. The bonus feature play, which may potentially be infinite enables a player to sit longer as the perspective of a long series of free games is embedded in this bonus feature play in accordance with the present invention.

Another possibility of the present invention is that a "Win Chain" award may optionally be used to create a higher bet and so to award a correspondingly higher payout for a particular spin, instead of awarding additional credits. This way, a threshold number of "Win Chains" may be utilized, e.g. to double or triple any payout as an alternative to awarding credits. Thus, a base payout value may be provided and a kind of multiplier values may be cumulated to multiply this base payout (credit).

Figure 3:
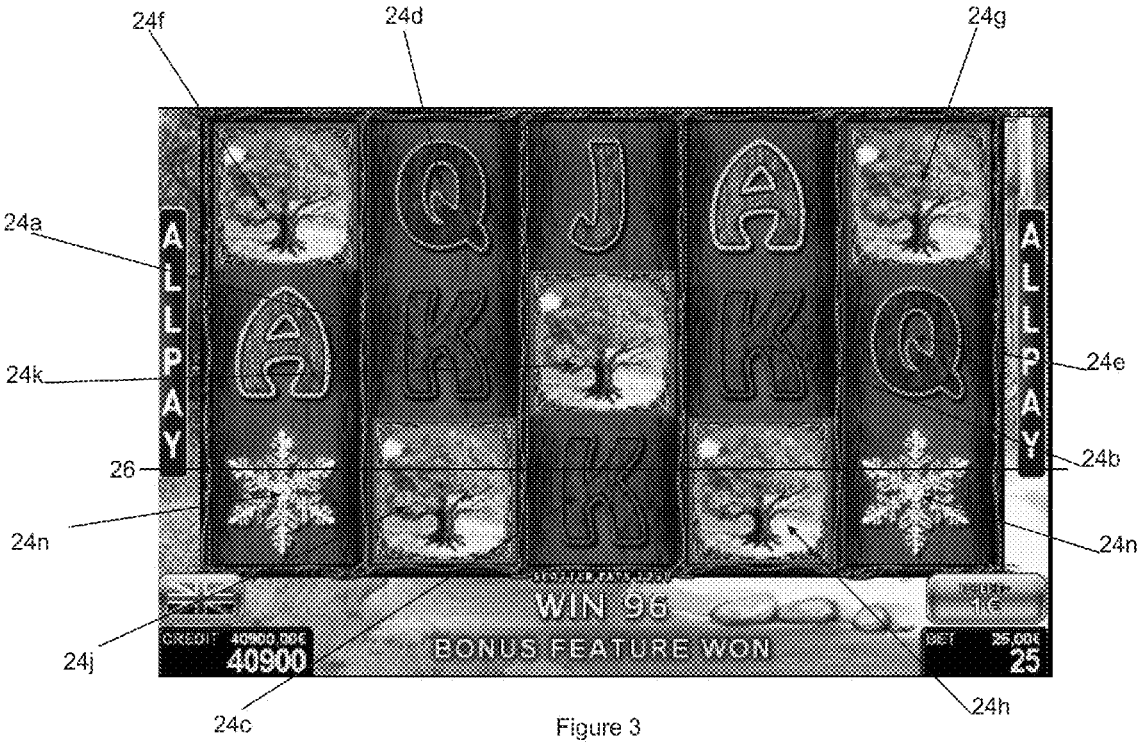
FIG. 3 is a screenshot of the display depicted after winning a bonus feature play in accordance with the present invention.

FIG. 3 shows the snapshot when a bonus feature play is won by a pay line 26 in the lower row. No more than one scatter symbol 24 is present in any single column. The payline 26 shows two scatter symbols 24*h* and 24*j*, one "K" symbol 24*c* and two "Star" symbols. Accordingly, a payout commensurate with the appearance of these symbols depicted on the payline 26 is indicated.

Figure 4:
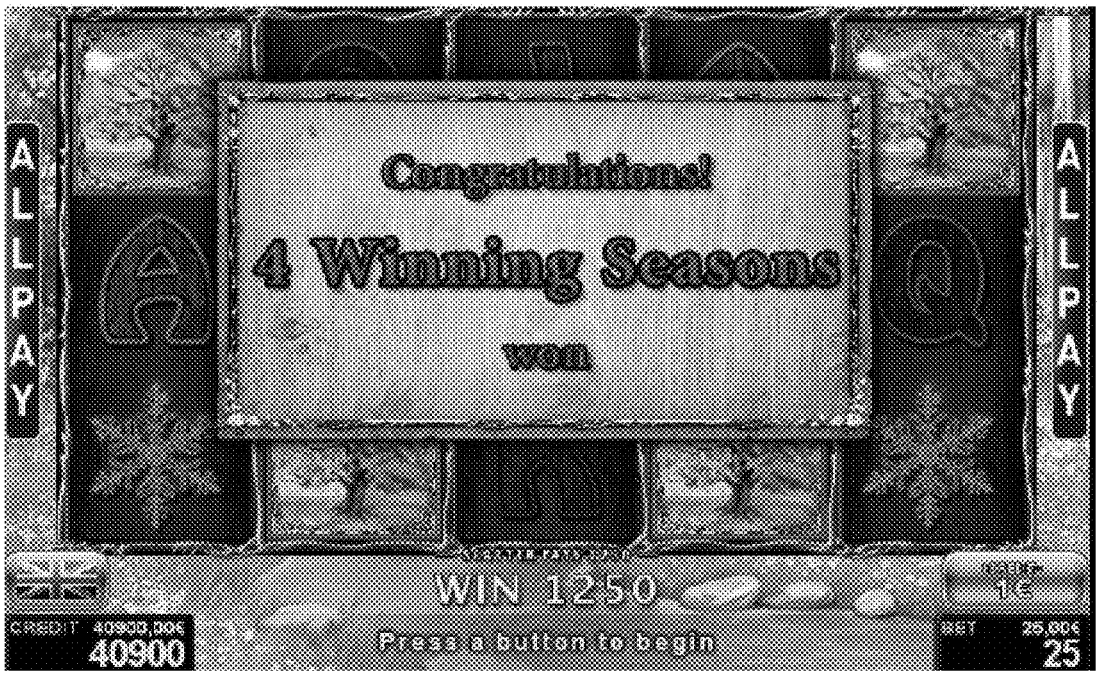
FIG. 4 is a screenshot of the notification of display after winning the "Winning Seasons" in accordance with the present invention.

FIG. 4 shows the display 14*a* in a bonus feature play. A "Congratulations!" message is displayed for winning the "4 Winning Seasons" and the player is asked to press the button on the user interface 16 to begin the bonus feature play.

Figure 5:
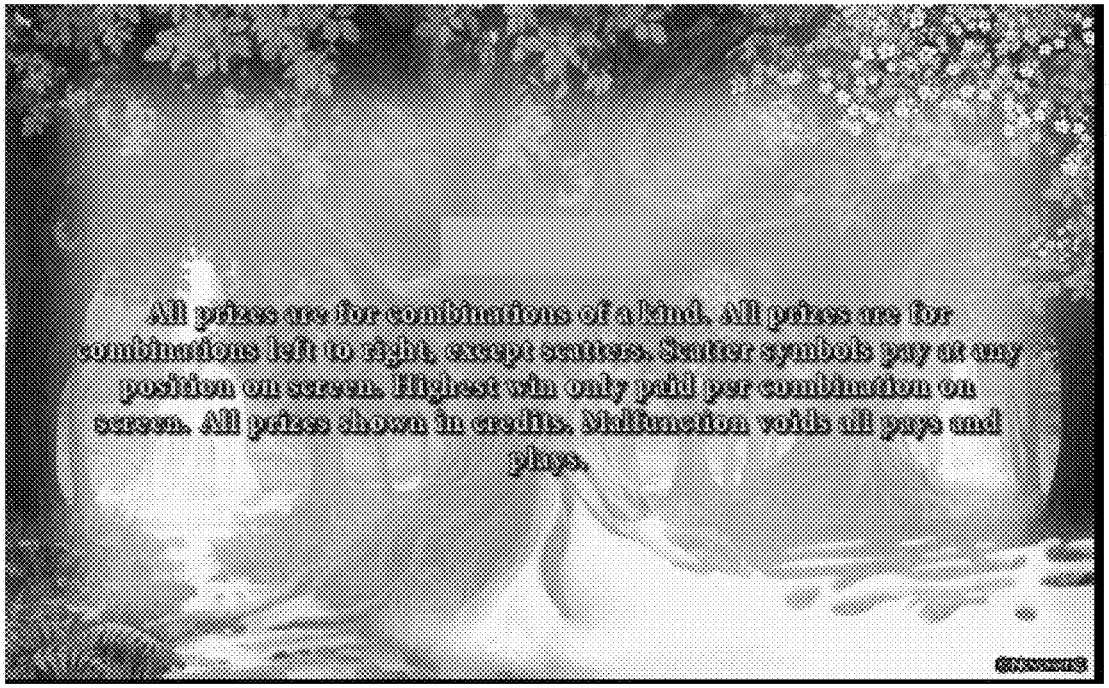
FIG. 5 is a screenshot of the steps for the bonus feature play in accordance with the present invention.

FIG. 5 shows a snapshot of the steps of the bonus feature play. It notifies that all prizes are for the combinations of a kind. Further, all prizes are only for the combinations running from left to right in the rows of the matrix. In addition, the scatter symbols are paid at any position on the screen or matrix. Further, the highest win is only paid per combination on the screen or matrix. Finally, all prizes are shown in credits only. It is also to be noted that any malfunction of the game voids all pays and plays of the game.

Figure 6:
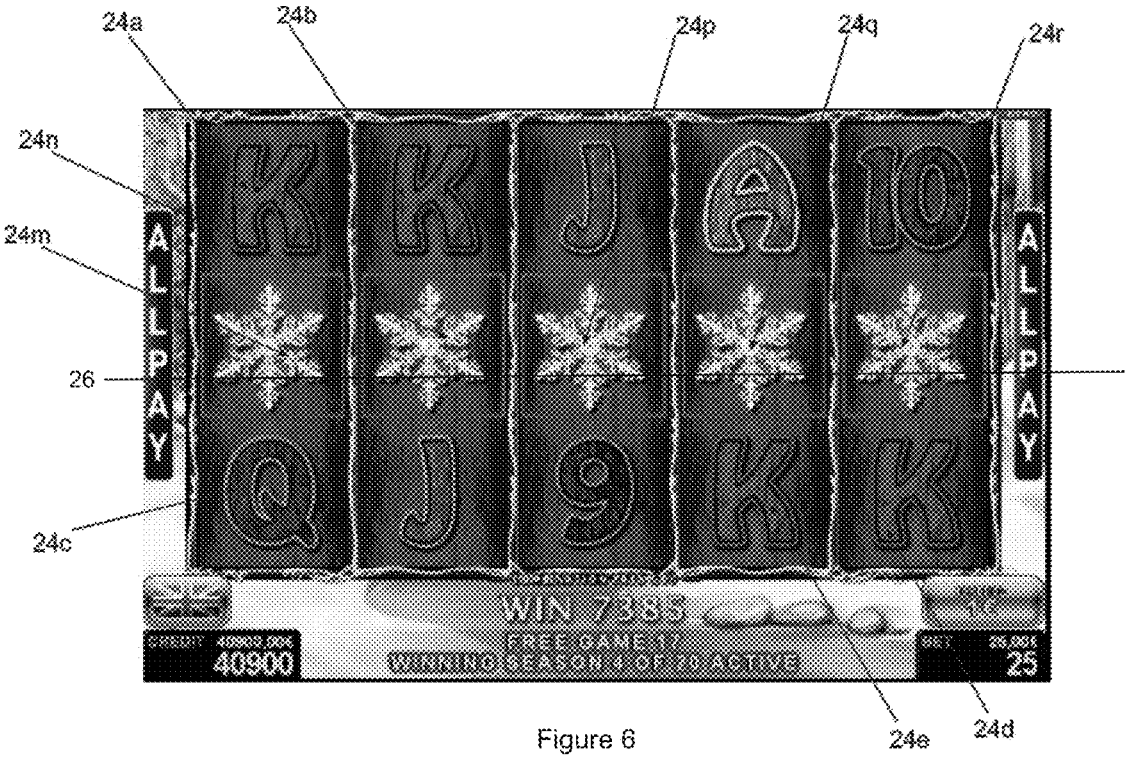
FIG. 6 is a screenshot of the display after continuing the "Winning Seasons" of the bonus feature play in accordance with the present invention.

FIG. 6 shows a payline 26 in the middle row having five "Stars". Since, the middle row includes a combination of a kind, i.e. "Stars", the "Winning seasons" is won by the player. As per the steps of the game, only the combination of two "K", 24*a* and 24*b* in the top row can win a prize, because it runs from left to right in the matrix. However, as per the steps shown in FIG. 5, the combination of two "K", 24*e* and 24*d* in the bottom row do not yield a prize, as the combination starts from right and runs leftwards in the matrix.

The position of the scatter symbols 24 in successive reel set spins is determined randomly. In particular, the random numbers defining the reel stops of these 5 reels are the random numbers 1-3. The random numbers define vertical positions of each scatter symbol on any particular reel (i.e. columns of the matrix).

Each scatter symbol can take any of the three possible random vertical positions in response to random numbers 1 to 3, which are generated by the computer. Symbol position 1 is the uppermost position on a reel set defined as row 1. Symbol position 2 is the middle position on row two of the reel set. Symbol position 3 is the lowermost position on the reel set.

Figure 7:
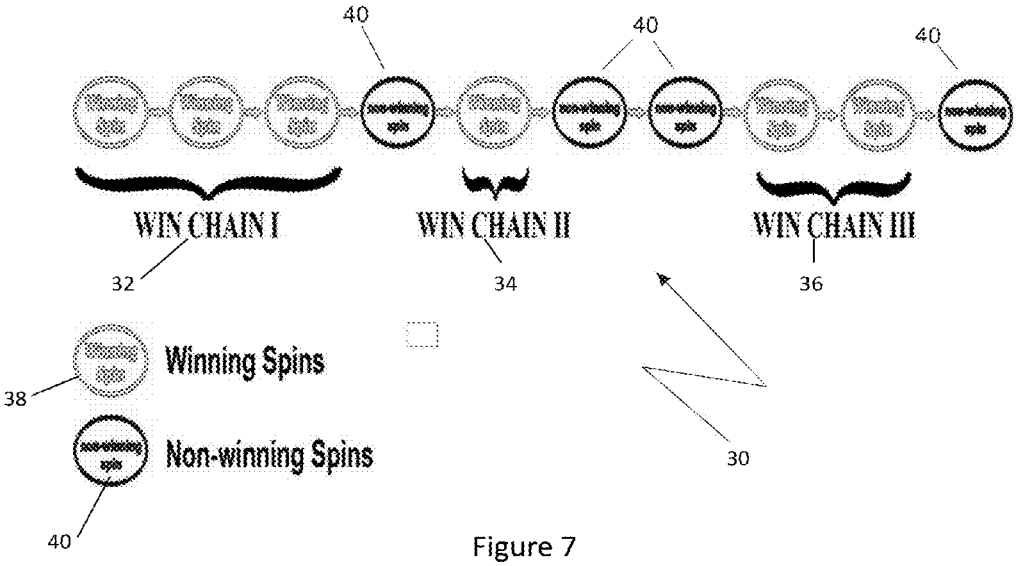
FIG. 7 is a representation of a series of win chains resulting from bonus feature play.

FIG. 7 illustrates the win chain concept in accordance with the present invention. A series of win chains 30 are represented by a sequence of win chains 32, 34 and 36, which are divided by at least one non-winning spin 40. Each non-winning spin 40 decrements, i.e. consume the value of the game play counter. The game play counter is initialized upon entry into bonus feature game play. Initialization of the game play counter sets an integer value of four to the game play counter. As shown, four non-winning spins decrement the game play counter by the integer value of four and thus, terminate game play.

The length of each win chain 32, 34 and 36 is fixed by, and is terminated by, a non-winning reel set spin 40. Each win chain 32, 34 and 36 an indeterminate length dictated by an uninterrupted sequence of winning reel set spins 38. The series of win chains 30 include a sum of winning spins, which may be used to award credits to a game user upon termination of bonus feature game play, or to otherwise provide improved payouts. Also the series of win chains 30 yields a sum of win chains that can be used to award increased payouts, in the form of credits, for example. The number of win chains 32, 34, and 36 depicted here is three. According to the sequence of game play steps the number of win chains can be any integer value between zero and four. However, variants of game play are anticipated and such variants can hold the possibility of an additional number of win chains of the set of win chains 30.

In win chain 32, three winning reel set spins 38 result prior to a non-winning reel set spin. In win chain 34 a single winning spin occurs prior to two non-winning spins, win chain 36 yields two winning reel set spins 38 prior to a single non-winning reel set spin. A reel set spin is defined as a player-initiated action of randomly changing a matrix of symbols depicted on the display as a set of reels in accordance with the present invention.

Figure 8:
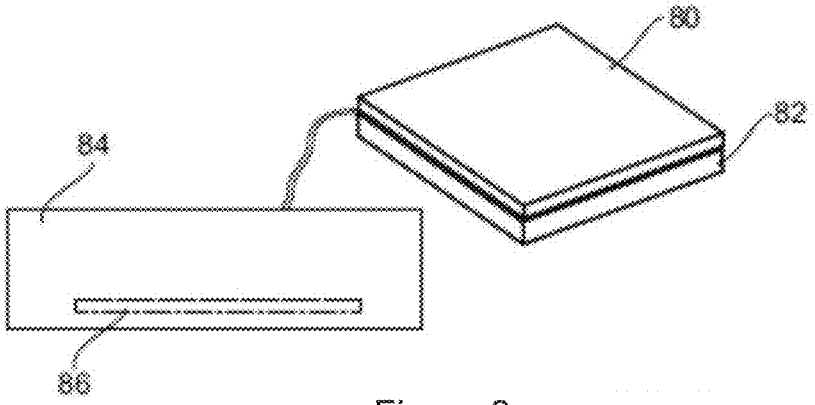
FIG. 8 is a perspective view of a computer and a display interface in accordance with the present invention.

FIG. 8 shows a computer 84, which is mounted in the housing 12 of the gaming machine 10. The computer 84 is connected to a display 80. The display 80 includes a transmissive LCD panel and may also include an integrated touchscreen 82. The computer 84 includes a PCB as the main board having a controller, memory for storing software for operating the display 80 which is also connected to the main board, software drivers, and a main processor, all mounted on the PCB. In a preferred embodiment, the computer 84 operatively connects with two displays, including the upper display 14*a* and a lower display 14*b* (see FIG. 1), to enhance user experience.

In one embodiment, standard game play mode is effectuated on the lower display 14*b* and bonus feature game play mode is effectuated on the upper display 14*a*. In an alternate embodiment the upper display 14*a* and the lower display 14*b* are duplicative to enable non-user observers to easily observe game play, and in this embodiment bonus feature game play mode replaces standard game play mode on both displays 14*a* and 14*b*. It can be appreciated that the present invention can also be utilized on a single display.

Figure 9:
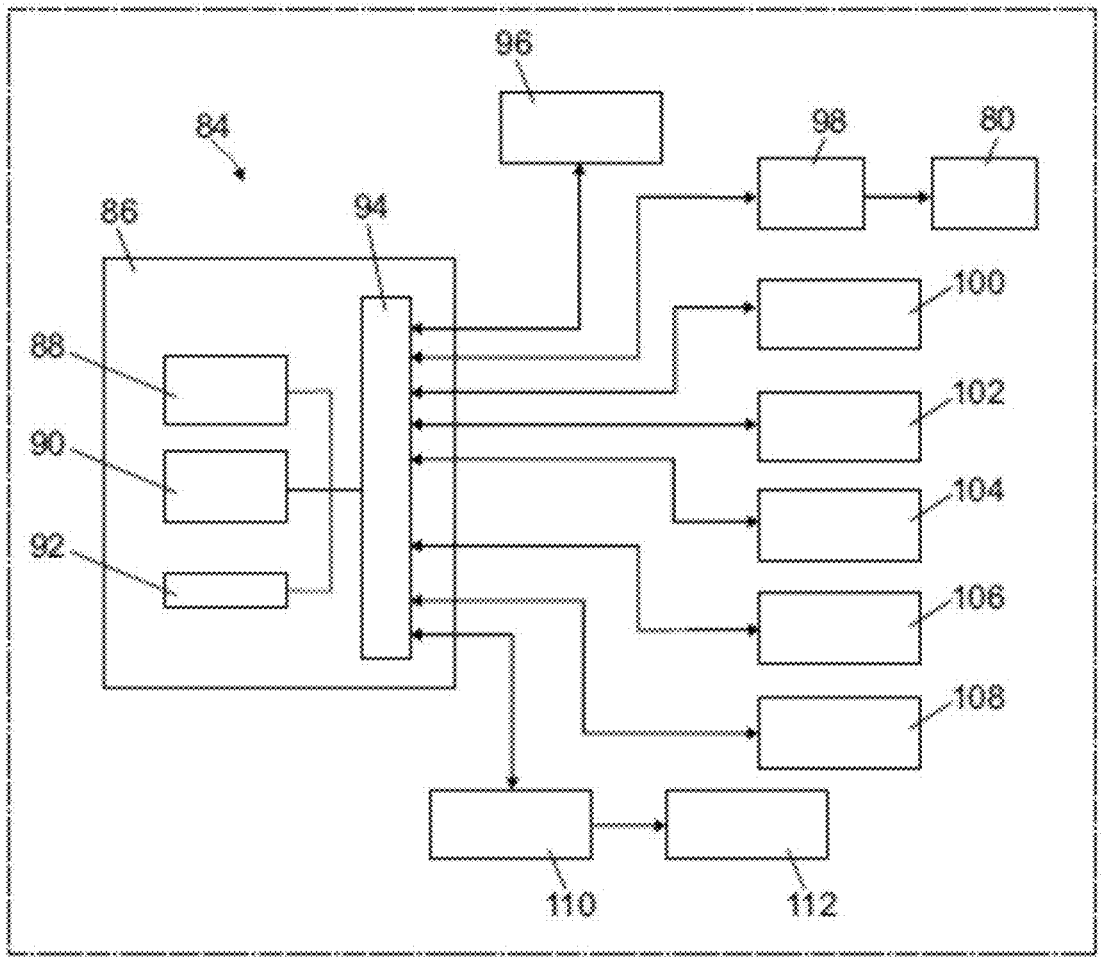
FIG. 9 is a system diagram in accordance with the present invention.

FIG. 9 shows a configuration diagram of the computer 84. The computer 84 includes a main board 86 or PCB, a program memory 88 configured as a computer readable medium, a main processor 90 and read only memory or RAM 92, all connected in operative communication with each other and also connected with an input output I/O controller 94 which in turn communicates with a user interface control panel 96, the display interface driver circuitry 98, a display unit 100, a coin receiver 102, a bill receiver 104, a card reader 106, a ticket reader/printer 108, and a sound circuit 110 respectively. The sound circuit 110 is in operative communication with speakers 112.

The coin receiver 102 and bill receiver 104 receive the respective currency and communicate the amount received therein to the I/O controller 94. The card reader 106 reads credit cards, debit cards, gift cards or other cards having electronic indicia of the monetary value.

The ticket reader 108 prints tickets and receipts revealing the winnings of a player, or other financial outcomes. The ticket reader 108 also receives tickets having indicia of monetary value, such as a bar code, which is read by the ticket reader 108.

The sound circuit 110 is configured to provide an acoustic-based interface for the user. Each movement or action by a user may result in a particular sound, or instruction being generated by the computer 84. The speakers 112 communicate the sounds to the user.

Figure 10:
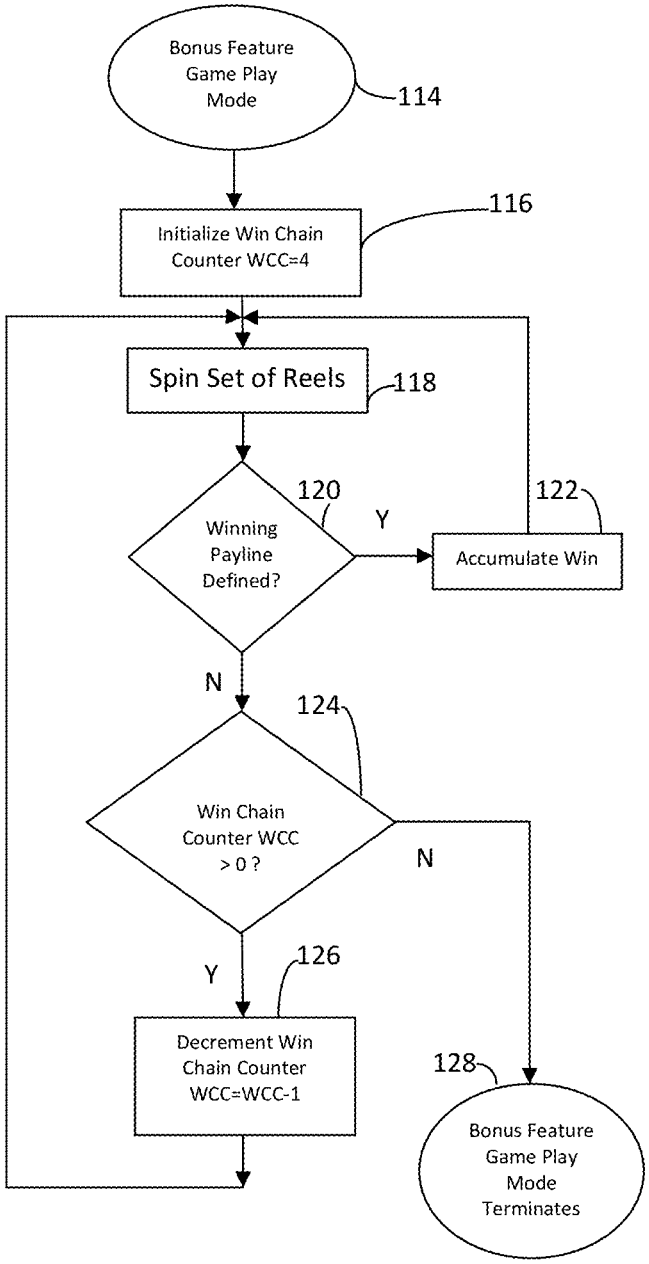
FIG. 10 shows the flow chart of an embodiment of the bonus game method in accordance with the present invention.

FIG. 10 shows the flow chart of an embodiment of a method in accordance with the present invention. The flow chart includes the step 114 of entering bonus feature game play mode, the step 116 of initializing the win chain counter, where the win chain counter (WCC) is initialized at WCC=4. The next step 118 spins a set of reels, which provides a matrix of random symbols. The step 120 decides if a winning pay line is defined by the reel spin. The step 122 accumulates and records a win when a pay line is defined in step 120. The step 124 checks whether the Win Chain counter (WCC) has met a threshold value, in this example the threshold value is zero, WCC>0? The step 128 terminates bonus feature game play mode when the win chain counter is not greater than zero, for example when WCC=0. The step 126 decrements the win chain counter value by one, WCC=WCC−1, when the win chain counter in step 124 is greater than zero, WCC>0. After step 126 and step 122, the step 118 of spinning the set of reels repeats.

The appearance of at least three scatter symbols in a reel set spin in the standard game play mode initiates bonus feature game play mode. Then for a predetermined number of win chains bonus feature play mode enables random reel set spins, or otherwise randomly changing the matrix of symbols to yield a win or a loss, wherein second evaluation means is provided for evaluating occurrence of a first non-winning spin after a winning spin upon which the win chain counter is updated. The win chain counter, WCC, is set at a an integer value of four so that that four seasons of the "Winning Seasons" bonus feature play can be played.

Next a reel set spin randomly changes the matrix of symbols, and if a winning play line e.g. 26 is defined, then a winning spin initializes a first win chain and this win is accumulated as credit to the player and the game proceeds to the next reel set spin.

Each non-winning reel set spin decrements the win chain counter by subtracting one from the integer value of from the win chain counter, i.e. one of the "Winning Seasons".

In the next step, the software evaluates whether the win chain counter WCC reads greater than a predetermined threshold integer value. In one embodiment the threshold integer value is zero. If the query is replied as a YES then the win chain counter WCC is decremented by one and reels are spun further. However, if the above query is replied in a NO, then the bonus feature game mode terminates.

In particular, a preferred method enables operating a slot-machine game with a computer. The slot-machine game has a display that displays matrix of symbols that may yield winning combinations. This matrix of symbols can take the appearance of a plurality or set of reels having various symbols represented thereon. A reel set spin randomly changes the matrix of symbols to resemble operation of a mechanical slot machine.

The computer has housing. The housing holds the computer and a display and a user interface. The computer is mounted in the housing and is programmed with game software for operating the gaming machine by controlling the display in response to the user interface, and for evaluating winning and non-winning reel set spins. In one embodiment, the computer, housing, display and user interface are integrated into a stand-alone kiosk.

In an alternate embodiment, the computer is a central server that communicates via a network with various client workstations having an interface and a display for controlling and viewing the slot-machine game. In this way, the game can be provided over the internet to a variety of users in varied locations.

The computer is programmed with game software having both a standard game play mode and a feature game play mode.

The method, typically used during bonus feature game play, initializes a win chain counter in step 116. Preferably this integer value is four. The gaming machine randomly changing the matrix of symbols to yield a win or a loss, in response to a user's input via the user interface. Changing the matrix of symbols is a "spin" of a reel set in one embodiment.

When a loss is yielded, the computer performs the step 124 of checking if the win chain counter is greater than zero, and the set 126 of decrementing the win chain counter by one. The game repeats beginning with step 118 of spinning the set of reels. While the game repeats, it can be appreciated that a player can choose to leave the game at any point, but since bonus feature play is exciting most players choose to continue to play in order to complete the bonus feature play so long as the win chain counter is greater than zero.

When the step 120 defines a win, the win chain counter remains constant and the game repeats with the step 118, which commences in response to input via the user interface. The step 122 records and accumulates the win by the computer in the memory as a new, or as part of an existing, a win chain.

The step 128 terminates the bonus feature game play mode when the step 124 reveals that the win chain counter has an integer value of zero. Standard game play mode then offers a user to continue game play.

The method step 116 of initializing a win chain counter establishes a win chain integer value. The step 126 of decrementing the win chain counter and the step 116 of initializing the win chain, are performed only in feature game play mode in one embodiment of the invention.

A particular advantage of this gaming concept that a game may be adapted advantageously in a simple manner with less needed symbols, using various game play modes, where at least one of the game play modes collates historical wins into a win chain. No further re-trigger symbols (and corresponding symbol handling) are necessary to grant additional beneficial (free) bonus spins, or game credits. This simplifies the game from the computational standpoint, but increases the complexity from the player's viewpoint. Calculating win-chains and recording win chains to memory is a simple operation for a computer. By utilizing the win-chain concept computational power required is reduced, and faster game speeds are enabled.

While the present invention is disclosed in terms of various specific embodiments, it can be appreciated that these embodiments are by way of example only. There are several variations contemplated by the present invention, and with the popularity of electronic gaming interfaces, the term "reel" should be broadly understood to include any set of moveable images, defining a matrix column, that are used to establish a payout. The term "random" or "randomly" are to be broadly defined herein to include pseudo-random, or pseudo-randomly, respectively. "Evaluation Means" should be understood as including software, firmware, hardware or any combination thereof. Accordingly, the scope of the invention is defined by the appended claims.

The invention claimed is:

1. A gaming machine operated by a computer, the gaming machine having a standard game play mode and a bonus feature play mode that include winning and non-winning reel set spins, the gaming machine comprising:

a housing having a user interface and a display attached to the housing;

a computer adapted for operative communication with the user interface and the display, and during the standard game play mode, the computer communicates with the display to randomly display a matrix of symbols including scatter symbols;

a first evaluation means operated by the computer for evaluating paylines and scatter symbols in the matrix, whereby upon appearance of a predetermined number of scatter symbols in the matrix the evaluation means triggers bonus feature play mode; and a second evaluation means operated by the computer during bonus feature play mode, the second evaluation means sums the number of winning reel set spins to initialize at least a first win chain, the first win chain terminates upon a non-winning spin;

the second evaluation means next sums the number of winning reel set spins to initialize at least a second win chain, the at least second win chain terminates upon a non-winning spin, the second evaluation means tracks the number of win chains; and a payout is calculated based on the number of winning spins in the at least first and second win chains, and the payout is multiplied by the number of win chains.

2. A gaming machine as set forth in claim 1, wherein upon termination of bonus feature play, the sum of winning spins in the first win chain yields bonus credits.

3. A gaming machine as set forth in claim 2, wherein after the first win chain is initialized, and prior to a non-winning reel set spin, winning reel set spins are added to the first win chain.

4. A gaming machine as set forth in claim 3, wherein after a non-winning spin updates the win chain counter, another winning reel set spin initializes a second win chain.

5. A gaming machine as set forth in claim 4, wherein after the second win chain is initialized, and prior to a second non-winning reel set spin, winning reel set spins update the second win chain.

6. A gaming machine as set forth in claim 5, wherein upon termination of bonus feature play, the sum of winning spins in the first and second win chains yield bonus credits to a player.

7. A gaming machine as set forth in claim 1, wherein bonus feature play commences when at least three scatter symbols appear.

8. A gaming machine as set forth in claim 7, wherein the bonus feature play yields at least four win chains.

9. A gaming machine as set forth in claim 8, wherein the gaming machine calculates a payout that is a multiple of the at least four win chains.

10. A gaming machine as set forth in claim 5, wherein the payout is at least doubled.

11. A gaming machine as set forth in claim 10, wherein the payout is tripled.

12. A gaming machine operated by a computer having a standard game play mode and a bonus feature play mode, the gaming machine comprising:

a housing having at least one user interface attached to the housing;

a computer in operative communication with the user interface, the computer having a printed circuit board provided with a program memory for evaluating game play, storing the game play instructions and symbols, a main processor, an input/output controller, and RAM, all connected in an operative communication with each other;

a user interface control panel connected to the input/output controller to enable the user to input instructions to enable game play;

during the standard game play mode, the user interface displays a matrix of symbols having a fixed size and the computer determines winning reel set spins based on the matrix of symbols;

upon appearance of a predetermined number of scatter symbols in the matrix of symbols bonus feature play commences and a win chain play counter having an integer value is initialized;

during bonus feature play, a winning spin initializes at least a first win chain, which terminates upon a first non-winning spin, and at least a second win chain, which terminates upon a second non-winning spin; and a payout is multiplied by the integer value of the win chain counter.

13. A gaming machine as set forth in claim 12, wherein after the second win chain is initialized, and prior to a second non-winning spin, winning spins are added to the second win chain.

14. A gaming machine as set forth in claim 13, wherein upon termination of bonus feature play, the sum of winning spins in the first and second win chain yields bonus credits to a player.

15. A gaming machine as set forth in claim 13, wherein the gaming machine calculates a payout based on a threshold number of win chains and the payout is at least doubled when the threshold number of win chains is met.

16. A gaming machine as set forth in claim 13, wherein the gaming machine calculates a payout based on a threshold number of win chains and the payout is tripled when the threshold number of win chains is met.

17. A method of operating a slot-machine game, comprising:

providing a computer and a housing having a display and a user interface, the computer being mounted in the housing for controlling the display in response to the user interface, the display displays matrix of symbols that may yield winning combinations;

initializing a win chain counter and establishing a win chain counter integer value;

randomly changing the matrix of symbols to yield a win or non-win;

when a non-win is yielded, decrementing the win chain counter value by one and repeating the step of randomly changing the matrix of symbols;

when a win is yielded, the win chain counter value remains constant and step of randomly changing the matrix of symbols repeats and when a win is not yielded the win chain counter decrements the win chain counter integer value;

when the win chain counter has an integer value of zero then the game terminates; and the computer calculates the number of win chains and uses the number of win chains as a multiplier to determine a bonus payout.

18. The method of operating a slot-machine game as set forth in claim 17, wherein the computer is programmed with game software having both a standard game play mode and a feature game play mode, wherein the step of decrementing the win chain counter value, and the step of calculating a payout by using the number of win chains and the cumulative number of winning reel set spins is performed only in feature game play mode.

* * * * *